US008087272B1

(12) United States Patent
Korban

(10) Patent No.: US 8,087,272 B1
(45) Date of Patent: Jan. 3, 2012

(54) LOCKING MECHANISM

(76) Inventor: Fouad F. Korban, Blue Bell, PA (US)

( * ) Notice: Subject to any disclaimer, the term of this patent is extended or adjusted under 35 U.S.C. 154(b) by 802 days.

(21) Appl. No.: 11/986,933

(22) Filed: Nov. 26, 2007

(51) Int. Cl.
*E05B 13/10* (2006.01)

(52) U.S. Cl. ..... 70/224; 70/215; 70/467; 70/478; 70/484; 292/337; 292/356; 292/357; 292/359

(58) Field of Classification Search ..... 70/447–449, 70/467, 469, 478, 224, 215–217, 489, 483–485, 70/473–475; 292/169, 169.14–169.17, 169.21–169.23, 292/337, 336.3, 356, 357, 359, DIG. 53, 292/DIG. 64

See application file for complete search history.

(56) References Cited

U.S. PATENT DOCUMENTS

| | | | | | |
|---|---|---|---|---|---|
| 60,974 | A * | 1/1867 | Weaver | 70/467 |
| 400,111 | A * | 3/1889 | Overton | 70/467 |
| 508,267 | A * | 11/1893 | Armstrong | 70/469 |
| 604,951 | A * | 5/1898 | Anderson et al. | 70/472 |
| 637,497 | A * | 11/1899 | Burden et al. | 70/467 |
| 769,768 | A * | 9/1904 | Phelps | 70/474 |
| 1,388,732 | A * | 8/1921 | McFall | 70/216 |
| 1,402,104 | A * | 1/1922 | Soss | 70/216 |
| 1,703,338 | A * | 2/1929 | Devereaux | 70/216 |
| 1,707,215 | A * | 4/1929 | Best et al. | 70/478 |
| 1,755,434 | A * | 4/1930 | Ellingson | 70/476 |
| 1,832,004 | A * | 11/1931 | Cramer | 70/482 |
| 1,843,143 | A * | 2/1932 | Rymer | 70/469 |
| 1,845,963 | A * | 2/1932 | Ellingson | 70/217 |
| 1,880,834 | A * | 10/1932 | Crenshaw | 70/469 |
| 2,454,145 | A * | 11/1948 | Erkkila | 70/448 |
| 2,538,688 | A * | 1/1951 | Heyer | 292/337 |
| 2,547,256 | A * | 4/1951 | Cerf, Jr. | 292/169.22 |
| 2,653,046 | A * | 9/1953 | Erkkila | 292/337 |
| 4,272,974 | A * | 6/1981 | Hennessy | 70/129 |
| 4,736,970 | A * | 4/1988 | McGourty et al. | 292/359 |
| 5,072,977 | A * | 12/1991 | Millman et al. | 292/336.3 |
| 5,481,890 | A * | 1/1996 | Millman | 70/224 |
| 5,727,406 | A * | 3/1998 | Banducci | 70/224 |
| 5,784,909 | A * | 7/1998 | Huang | 70/224 |
| 6,360,569 | B1 * | 3/2002 | Huang | 70/215 |
| 6,568,725 | B2 * | 5/2003 | Furlong et al. | 292/336.5 |
| 6,698,803 | B2 * | 3/2004 | Furlong | 292/165 |
| 6,705,138 | B1 * | 3/2004 | Shen | 70/224 |
| 6,735,993 | B2 * | 5/2004 | Eller et al. | 70/224 |
| 6,807,833 | B1 * | 10/2004 | Huang et al. | 70/107 |
| 7,559,219 | B2 * | 7/2009 | Chen | 70/224 |
| 2005/0057051 | A1 * | 3/2005 | Bartos | 292/337 |

* cited by examiner

*Primary Examiner* — Lloyd Gall
(74) *Attorney, Agent, or Firm* — Stephen G. Stanton, Esq.

(57) ABSTRACT

A locking mechanism is provided that has an unlocked position and a locked position. The locking mechanism comprises the following. A first handle. A first rose attached to the first handle with the first handle adapted for rotational movement relative to the first rose. A first longitudinal slot in the first rose. A locking cartridge cylinder at least partially contained within at least the first handle or the first rose. A locking tab operably connected to the locking cartridge cylinder adapted for movement: at least partially into at least the second slot in the first rose in a locked position; and completely out of the first longitudinal slot in the first rose in an unlocked position.

15 Claims, 13 Drawing Sheets

LOCKING MECHANISM

FIELD OF THE INVENTION

The present invention relates to an improved locking mechanism for use with a door or other structure, for example.

BACKGROUND OF THE INVENTION

The so-called American modern era door locking design surfaced circa 1932 and such locks were required but to keep the door handles locked. Such handles were usually round.

Now many handles have an elongated portion permitting a relatively large torque force to be more easily exerted upon the internal locking mechanism. This torque may distort/break sufficient internal parts/mechanisms to permit the lock to be relatively easily defeated and entry gained.

SUMMARY OF THE INVENTION

Accordingly, it is an object of the present invention to provide an improved internal lock assembly for use with door locks.

Other objects will appear hereinafter.

It has now been discovered that the above and other objects of the present invention may be accomplished in the following manner. Specifically, a locking mechanism is provided that has an unlocked position and a locked position. The locking mechanism comprises the following. A first handle. A first rose attached to the first handle with the first handle adapted for rotational movement relative to the first rose. A first longitudinal slot in the first rose. A locking cartridge cylinder at least partially contained within at least the first handle or the first rose. A locking tab operably connected to the locking cartridge cylinder adapted for movement: at least partially into at least the second slot in the first rose in a locked position; and completely out of the first longitudinal slot in the first rose in an unlocked position.

BRIEF DESCRIPTION OF THE DRAWINGS

The present invention will be more dearly understood from the following description taken in conjunction with the accompanying drawings in which like reference numerals designate similar or corresponding elements, regions and portions and in which:

FIG. 13 is a schematic, perspective view of an exemplary locking mechanism of the present invention installed in a door or the like.

DETAILED DESCRIPTION OF THE PREFERRED EMBODIMENT

The term "about" when referring to a numerical range or value is a convenience and is to be interpreted as plus or minus 10% of that value or range. For example "from about 100 to 1000" is to be interpreted as within the range of 90 to 1100 and "about 1000" is to be interpreted as from 900 to 1100.

Figure 7:
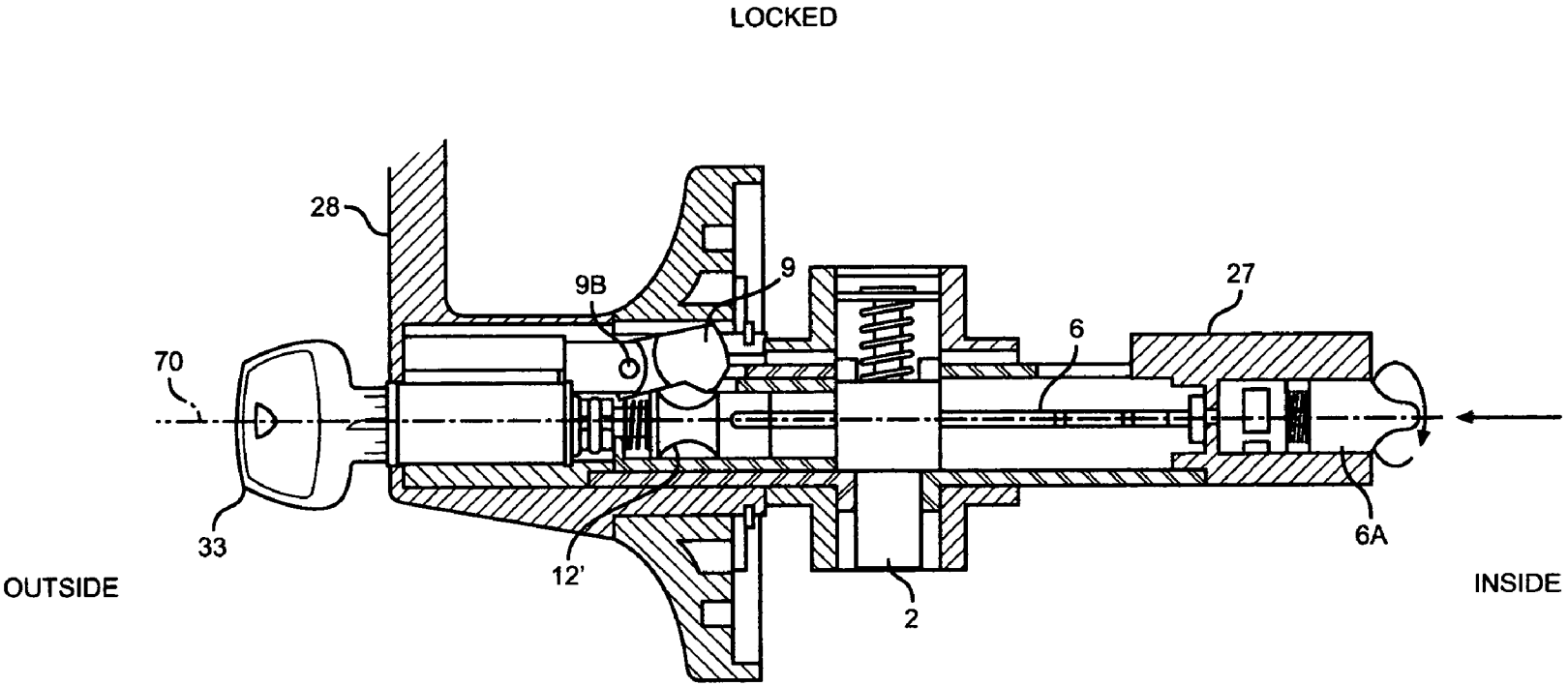
FIG. 7 is a side, cross-sectional view of the locked position of an exemplary embodiment of the present invention sans door.

One exemplary embodiment of the present invention utilizes a novel locking tab 9/exterior rose longitudinal slot 52B' arrangement to achieve an exemplary door locking mechanism 100 with torque bearing parts/portions that may achieve door locking mechanisms capable of withstanding and resisting much higher torque applied to an exterior handle 28 without failure of the locking mechanism when in the locked position (see, for example, FIG. 7 for the locked position). For example, door locking mechanisms 100 in the locked position and made in accordance with the teachings of the present invention may withstand/resist torques up to about 3000 pound torque without failure of the locking mechanism 100.

In another exemplary embodiment of the present invention, there is presented a novel hub core assembly 1 that may more strongly resist tampering.

Use of the Terms "Exterior"/"Outside" and "Interior"/"Inside"

In the instant invention, the terms "exterior"/"outside" ("exterior") refers to elements/structures towards the exterior or outside of a door or other structure within which the door locking mechanism 100 is retained and the terms "interior"/"inside" ("interior") refers to those towards the interior or interior of the door or other structure. The exterior/outside (exterior) is considered the direction from which third parties are prevented from entry by the locking of door locking mechanism 100 of the present invention in certain exemplary embodiments and the interior/inside (interior) is considered the direction from which occupants reside or are positioned to benefit from the locking of door locking mechanism 100 in certain exemplary embodiments.

It is noted that the teachings of the present invention may also be arranged to fortify unauthorized exit from the inside/interior of the door or from both the outside/exterior and inside/interior of the door or other structure by utilizing the locking tab 9/rose longitudinal slot 52B' in the analogous interior structures or both the exterior and interior structures.

It is also noted that the terms "exterior," "outside," "interior," and "inside" are used for ease of understanding with the illustrated exemplary embodiments of the present invention are not limiting.

Figure 1:
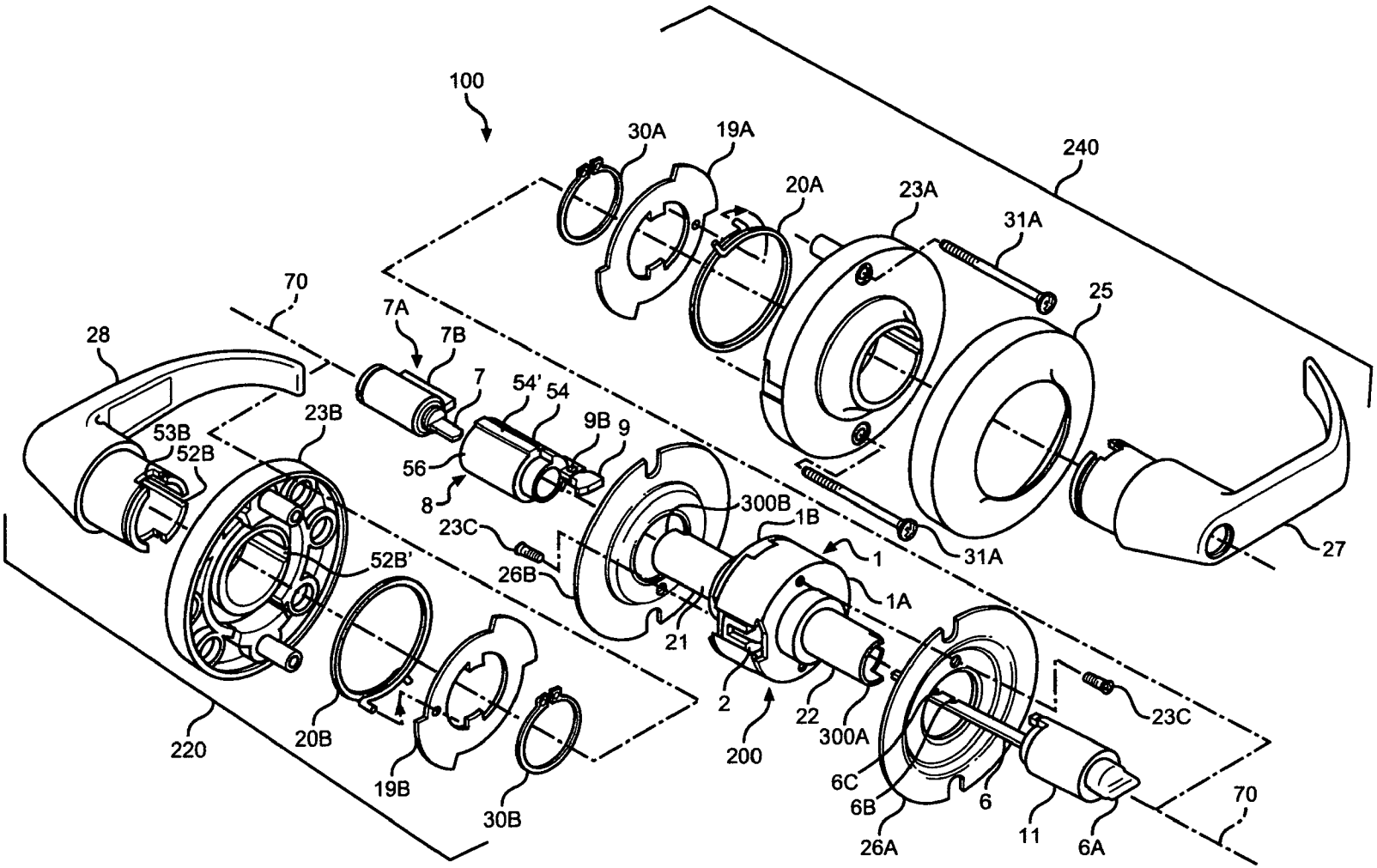
FIG. 1 is a schematic, perspective partially exploded view of an partially assembled exemplary embodiment of the present invention.

FIG. 1-P*artially* Assembled Locking Mechanism 100

As shown in FIG. 1, an exemplary locking mechanism 100 is shown in partially exploded view. As will be described in greater detail, door locking mechanism 100 may include hub core assembly 200 (with enclosed lockcore retractor 2 showing) operably connected to an exterior/outside (exterior) handle assembly 220 at an exterior/outside (exterior) end and to an interior/inside (interior) handle assembly 240 at another opposing interior/inside (interior) end.

Also shown in FIG. 1 are:

a key drive assembly 7A retained within exterior handle 28 of exterior handle assembly 220;

an exterior locking cartridge cylinder 8 at least partially received within the exterior handle assembly 220 proximate the exterior end 300B of hub core assembly 200;

exterior and interior retainer plates 26B, 26A positioned between respective exterior handle assembly 220 and interior handle assembly 240;

interior locking cartridge 11 received within interior handle assembly 240 with plunger 6 extending from interior locking cartridge 11 and received within hub core assembly 200 and with lock button 6A;

threaded interior/exterior retainer plate screws 23C for retaining interior/exterior retainer plates 26A, 26B;

threaded interior rose screws 31A for attachment of interior rose 23A to exterior rose 23B; and longitudinal axis 70 that extends from the center of exterior and interior handles 28, 27 through hub core assembly 200 which may further comprise door locking mechanism 100.

While not shown in FIG. 1, the door locking mechanism 100 may be retained within a door or other structure (1300—see FIG. 13, for example) with: (1) exterior handle 28 and exterior rose (rosette) 23B; and (2) interior handle 27 and interior scallop 25 covering interior rose (rosette) 23A, exposed on the respective exterior and interior sides of the door.

Figure 11:
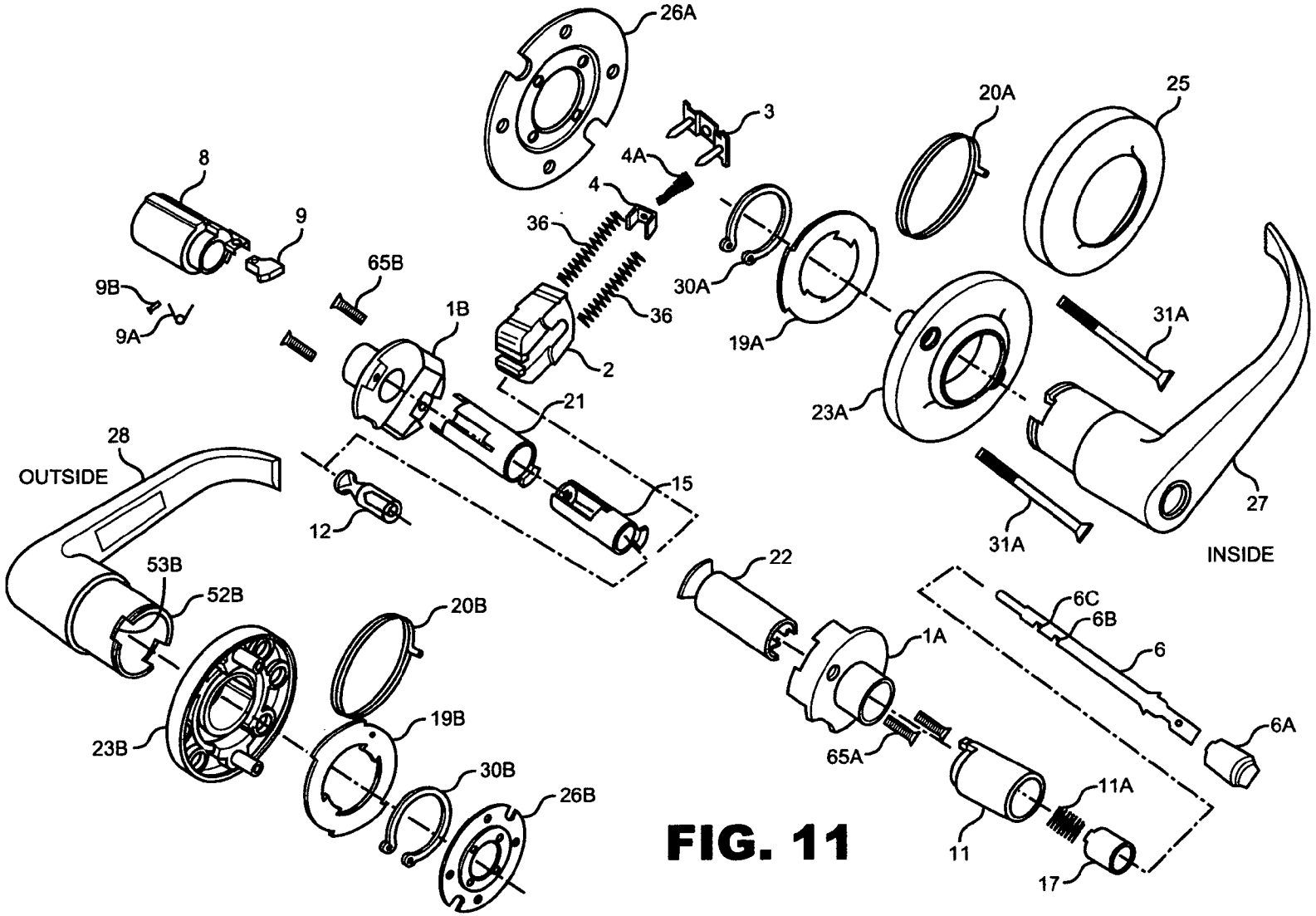
FIG. 11 is a schematic, perspective exploded view of an exemplary embodiment of the present invention showing an exemplary internal 53 Function assembly.

Referral to FIG. 11—Exploded View of Locking Mechanism 100

FIG. 11 illustrates a more detailed exploded view of the door locking mechanism 100 that may be referred to as necessary. It is noted that FIG. 11 includes an exemplary so-called "Function 53" by which the door locking mechanism 100 may be used, i.e., e.g. that employs cam and plug 12. Other Functions may be used, for example, but not limited to: (1) "Function 80" that employs cam 14 by which a key 33 (see, for example, FIGS. 6A and 7) must be used to actuate the locking cartridge cylinder 8 and unlock the otherwise locked door locking mechanism 100; (2) "Function 70" in which exterior cylinder 22 replaces spindle key 15 (see next sentence) and spindle cylinder 21 as shown in, for example, FIGS. 8 and 10; and the further exemplary function described in FIGS. 12A to 12H (see below for a detailed description). Each of the Functions 80 and 53 also each employ spindle key 15 which is received within spindle cylinder 21.

FIG. 1 Continued

The specific parts required for the select Function of the door locking mechanism may be assembled and retained by hub core 1 that may be comprised of interior housing 1A and exterior housing 1B. Lockcore retractor (retractor) 2 and its associated parts 3, 4, 4A, 36 comprise lockcore retractor assembly 250 (see FIG. 8, for example) Retractor assembly 250 may also be assembled and retained within hub core 1. While not shown in FIG. 1, a latch mechanism may be connected to retractor 2 so that when retractor 2 retracts within hub core 1, a latch (1302—see FIG. 13, for example) may retract within the latch mechanism and out of a latch hole (not shown) in, for example, an adjacent door jamb (not shown).

Figure 2A:
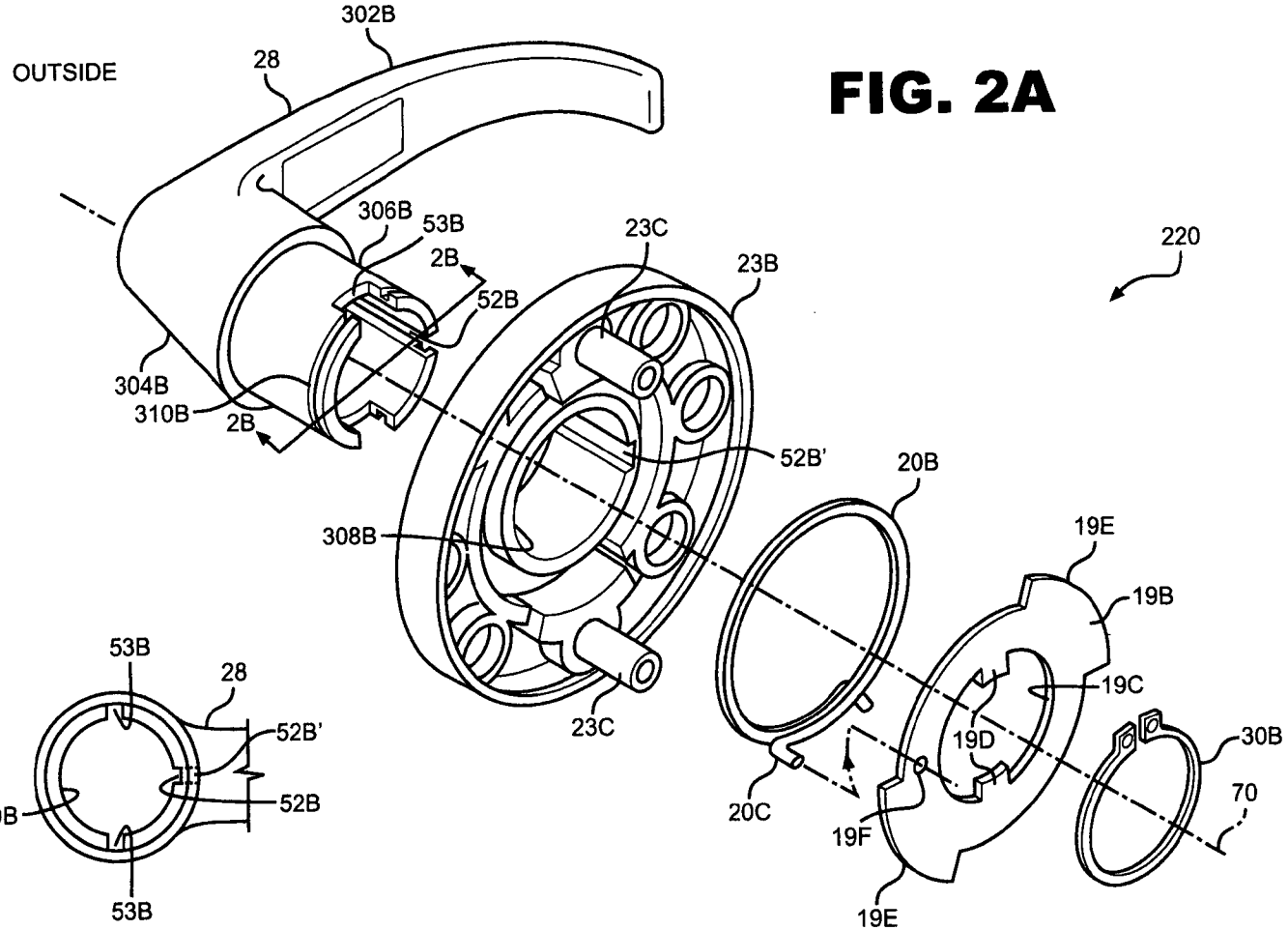
FIG. 2A is a schematic, perspective exploded view of a portion of an exemplary exterior/outside handle assembly of the present invention.
Figure 2B:
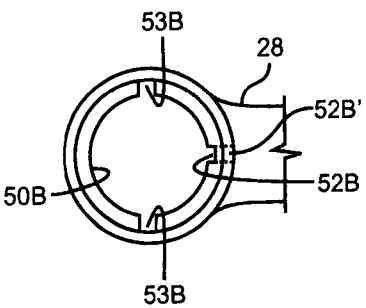
FIG. 2B is a schematic, perspective end view of the exemplary exterior/outside handle along line 2B, 2B of FIG. 2A of the present invention.
Figure 3:
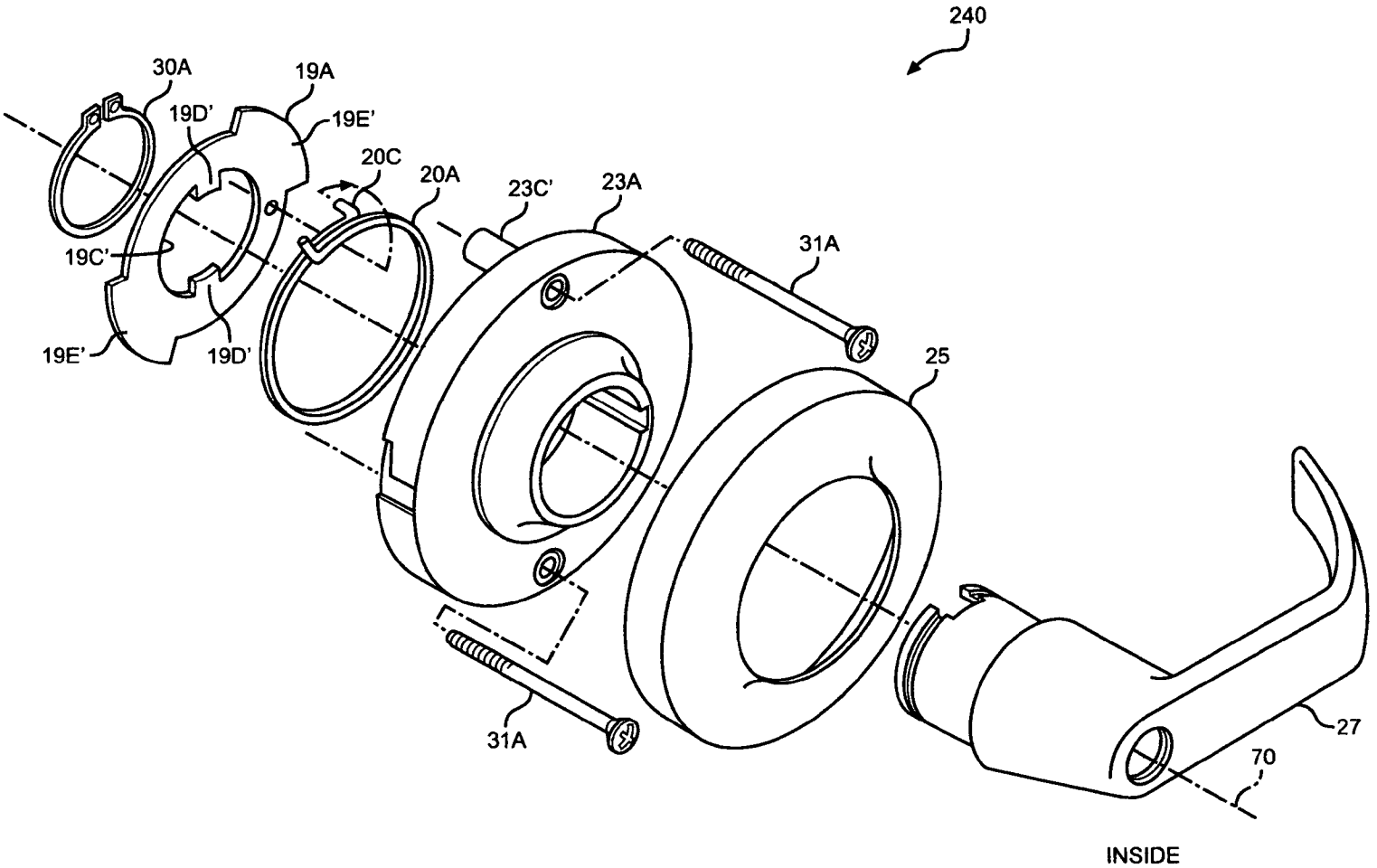
FIG. 3 is a schematic, perspective exploded view of a portion of an exemplary interior/inside handle assembly of the present invention.

FIGS. 2A, 2B and 3—Exterior and Interior Handle Assemblies 220, 240

FIGS. 2A, 2B and FIG. 3 illustrate respective exterior and interior handle assemblies 220, 240 in larger perspective. The following description of exterior handle assembly 220 may also apply to interior handle assembly 240, and will not be repeated, except that the first longitudinal slot 52B and longitudinal groove 53B in exterior handle 28 and the second longitudinal slot 52B' in exterior rose 23B may not be required in interior handle 27 and interior rose 23A unless an interior locking cartridge cylinder (not shown), analogous to exterior locking cartridge cylinder 8, is employed with interior handle 27/interior rose 23A. It is also noted that interior handle 27 may be identical to exterior handle 28 whether or not another interior locking cartridge cylinder (not shown) may be used.

FIGS. 2A—Exterior Handle Assembly 220

As illustrated in FIG. 2A, in an exemplary embodiment of the present invention, exterior handle assembly 220 may include, for example, exterior handle 28, exterior rose 23B, exterior retainer spring 20B, exterior positive stop 19B and exterior retaining ring 30B which may be assembled in the order illustrated. It is noted that positive stop 19B is outside spindle 21, that is spindle 21 may be received within positive stop 19B (e.g., see FIG. 6A).

It is noted that the interior and exterior positive stops 19B, 19A of the present invention are designed to be interchangeable. That is two positive stop elements may be used for the interior positive stop 19B and the exterior positive stop 19A. Further the same positive stops 19B, 19A may be used for a left hand opening door and a right hand opening door.

Exterior handle 28 may include an elongated handle 302 and a cylindrical portion 304 that may include a reduced outside diameter portion (reduced cylindrical portion) 306. Reduced cylindrical portion 306 may include a circumferential groove 310B within which exterior retaining ring 30B may fit to retain exterior handle 28 adjacent exterior rose 23B. Retaining ring 30B may also retain exterior positive stop 19B and exterior retainer spring 20B adjacent to exterior rose 23B as will be described in more detail below.

Exterior rose 23B may include a central opening 308B within which reduced cylindrical portion 306B of exterior handle 28 may fit so that exterior handle 28 may rotate relative to exterior rose 23B. It is noted that when the locking mechanism 100 is mounted within a door or other structure (1300), exterior and interior roses 23B, 23A may be fixed while exterior and interior handles 28, 27 may be adapted for partial rotational movement within the limits of respective exterior and interior positive stops 19B, 19A (see below).

Exterior positive stop 19B may be ring shaped with a central opening 19C having two opposing interior tabs 19D that partially project into central opening 19C and two opposing exterior tabs 19E that project outwardly from exterior positive stop 19B. Exterior handle 28 may further include opposing slots 53B within which the opposing interior tabs 19D of exterior positive stop 19B may fit so that rotation of exterior handle 28 may rotate exterior positive stop 19B within the limits described herein. It is noted that reduced cylindrical portion 306B of exterior handle 28 may fit within central opening 308B of exterior rose 23B. One skilled in the art would appreciate that the thickness of exterior rose 23B, proximate central opening 308B, may be sized so that opposing interior tabs 19D may fit within the opposing slots of exterior handle 28 such that tabs 19D nearly contact, or contact the respective opposing inward walls of the exterior handle 28 opposing slots. Exterior rose 23B may include screw studs 23C that projects toward hub core assembly 200 and between which opposing exterior tabs 19E of exterior positive stop 19B may contact upon rotation of exterior handle 28, thus limiting the rotation of exterior handle 28. (It is noted that interior rose 23A may likewise include screw studs 23C that projects toward hub core assembly 200 and between which opposing exterior tabs 19E' of interior positive stop 19A may contact upon rotation of interior handle 27, thus limiting the rotation of interior handle 27.)

Exterior retainer spring 20B may be a helical coil spring and may include as least one projecting terminal end 20C which may fit within a spring hole 19F in exterior positive stop 19B. Exterior retainer spring 20B may bias the extended portion of exterior handle 28 in a first position that is usually horizontal. When exterior handle 28 is rotated to open the door 1300 to which the door locking mechanism 100 is affixed, its limits of rotation may be defined by the rotation of positive stop 19B and the engagement of opposing interior tabs 19D against exterior rose screw studs 23C.

As more dearly shown in FIG. 2B, exterior handle 28 may include, on its interior surface 50B, a first longitudinal slot 52B and a longitudinal groove 53B parallel to, and offset from, first longitudinal slot 52B. As shown in FIG. 2A.

In an alternate exemplary embodiment, exterior rose 23B may include a second longitudinal slot 52B' that may be alignable with first longitudinal slot 52B of exterior handle 28 when exterior handle 28 is in its biased horizontal position. Such a second longitudinal slot 52W may be nonrotational in relation to the rest of handle 28 and may receive locking tab 9 when in the locked position (with or without second longitudinal slot 52B' of exterior rose 23B).

FIG. 3—Interior Handle Assembly 240

As noted above, interior handle assembly 240 may be essentially identical to exterior handle assembly 220 described above so a detailed description need not be repeated here. However, interior handle assembly 240 includes an interior scallop 25 that may fit over interior rose 24A so that the heads of threaded interior rose screws 31A may be covered.

Referring back to FIG. 1, one key structural feature of a preferred embodiment of the present invention is that exterior locking cartridge cylinder 8 (that includes moveable locking tab 9) may be at least partially retained within exterior handle 28 or exterior rose 23B so that locking tab 9 may be removably inserted into second longitudinal slot 52B' of exterior rose 23B. (Also see, for example, FIGS. 6 and 7 described hereafter.)

As shown in FIG. 11, and which may be referred to during the following descriptions, an exemplary door locking mechanism 100 is shown in exploded view. Door locking mechanism 100 is shown with cam and plug 12 (unique to Function 53), spindle key 15, spindle cylinder 21 and interior cylinder 22.

Figure 6B:
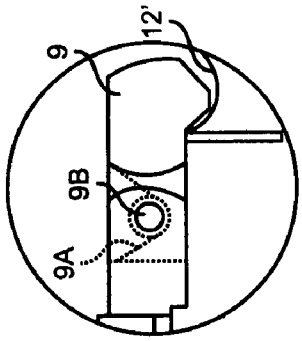
FIG. 6B is an enlarged portion of FIG. 6A at circle 6B proximate the locking tab.

Exterior locking cartridge cylinder 8 may include locking tab 9 that may be connected to cylinder 8 by a lock pin 9B (also see, for example, FIG. 6B). Locking tab 9 may be rotated about lock pin 9B from an unlocked position (as shown in FIG. 6) to a locked position (as shown in FIG. 7) and may be biased by a lock pin spring 9A in the unlocked position.

Figure 4:
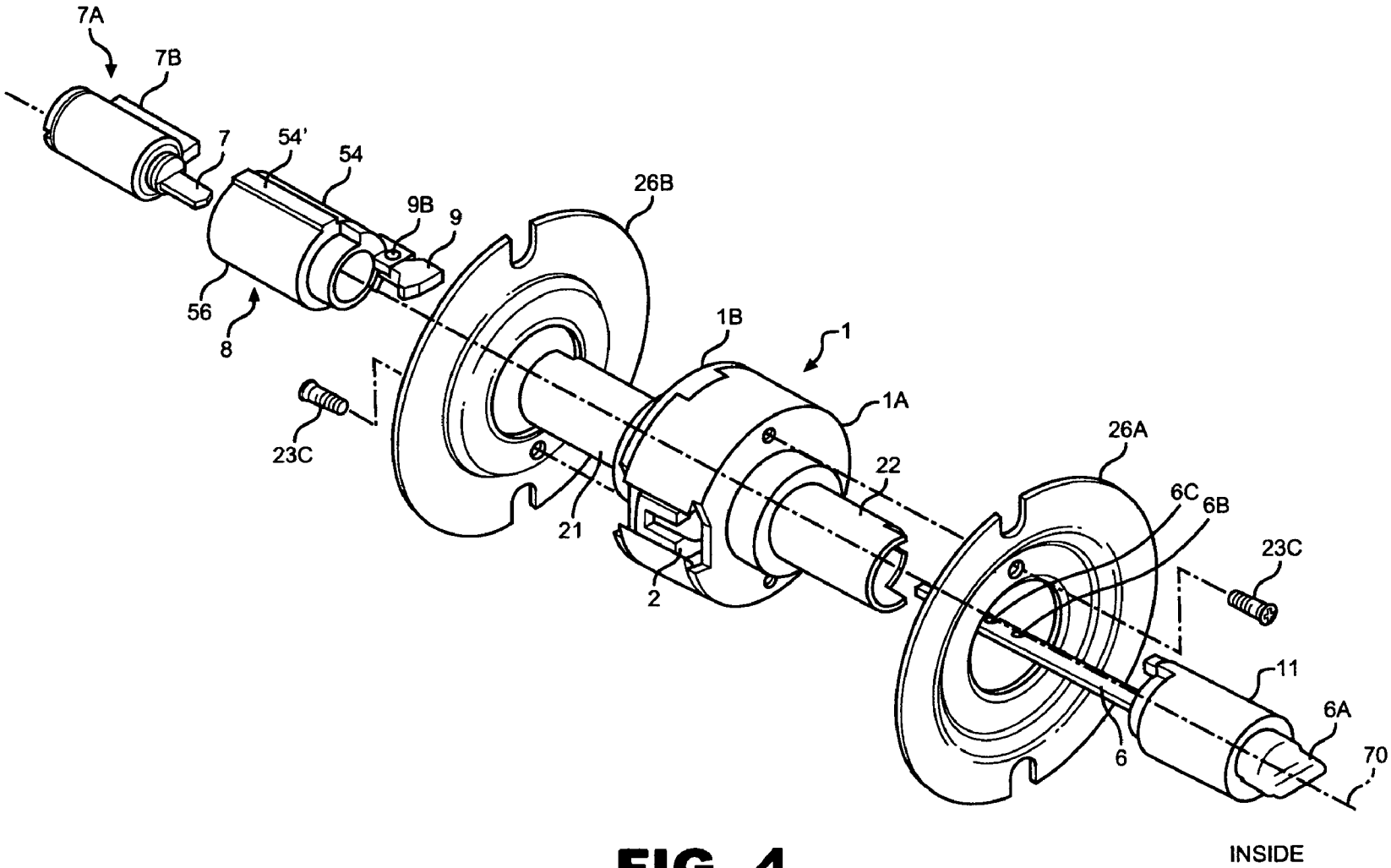
FIG. 4 is a schematic, perspective semi-assembled view of an exemplary hub core assembly of the present invention with an exemplary exterior/outside locking cartridge assemble and other select exemplary associated parts.

FIG. 4—Hub Core Assembly 1

FIG. 4, in an exemplary embodiment of the present invention, illustrates just the central portion of FIG. 1, that is hub core (assembly) 1 (with lockcore retractor 2 therewithin), exterior and interior retainer plates 26B, 26A, exterior locking cartridge cylinder 8, key drive assembly 7A and interior locking cartridge 11 with lock button 6A and plunger 6.

Figure 6A:
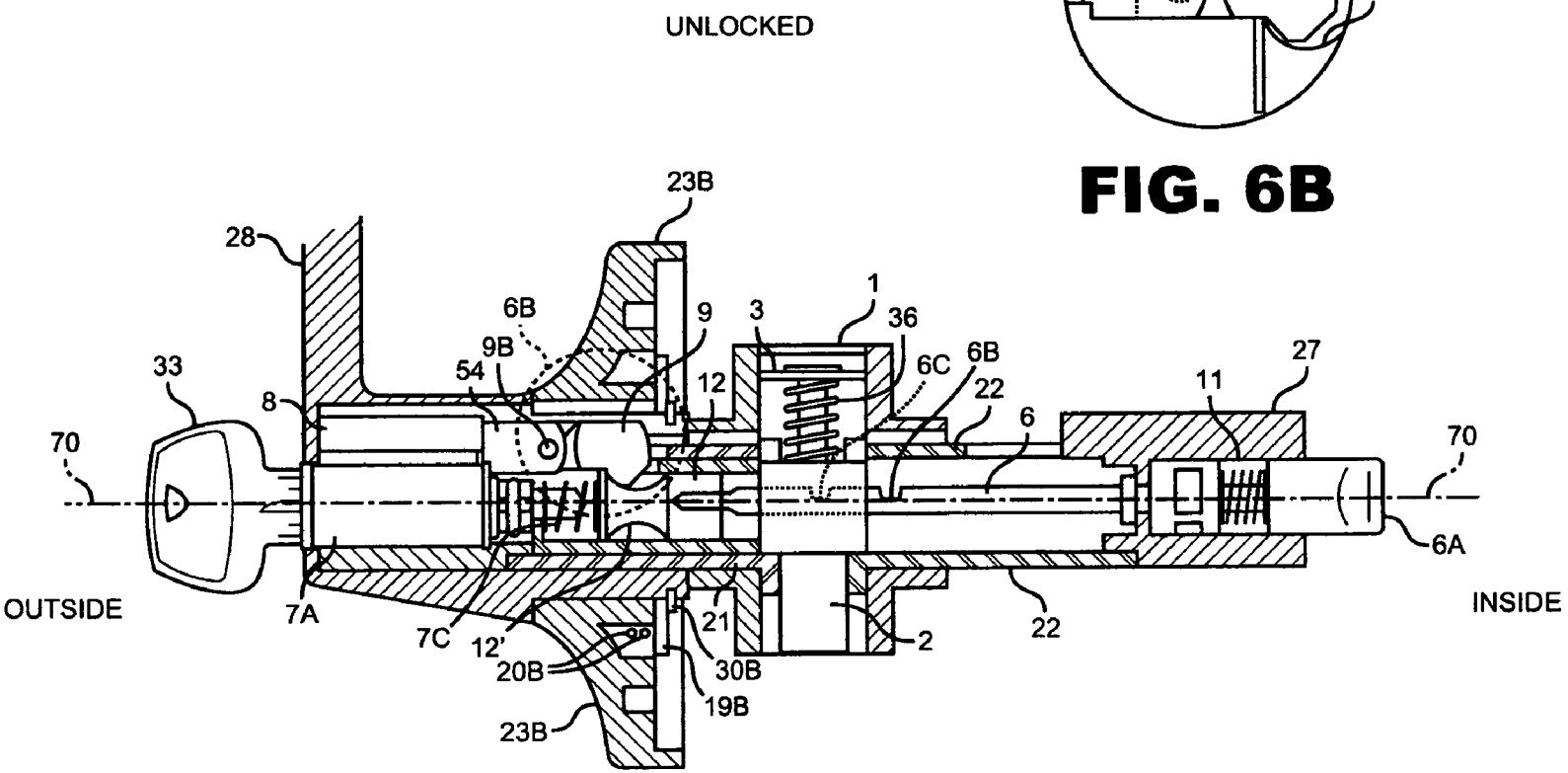
FIG. 6A is a side, cross-sectional view of the unlocked position of an exemplary embodiment of the present invention sans door.

As shown in FIG. 4 exterior locking cartridge cylinder 8 may further include, on its exterior surface 56, a first longitudinal fin 54 aligned with locking tab 9, and a second longitudinal fin 54' that may be parallel with, but offset from, first fin 54. As shown in FIGS. 6A, 7 and 11, for example, in exemplary embodiments of the present invention, locking cartridge cylinder 8 may be at least partially inserted into handle 28 so that: the cylinder's 8 first fin 54 may be received within exterior handle's 28 first slot 52B; and the cylinder's 8 second fin 54' may be received within exterior handle's 28 longitudinal groove 53B (also see, for example, FIG. 2B). This may prevent the rotation of exterior handle 28 independent of locking cartridge cylinder 8. Thus, when locking cartridge 8 is prevented from rotation, exterior handle 28 may not rotate and the door locking mechanism 100 is locked.

Figure 5:
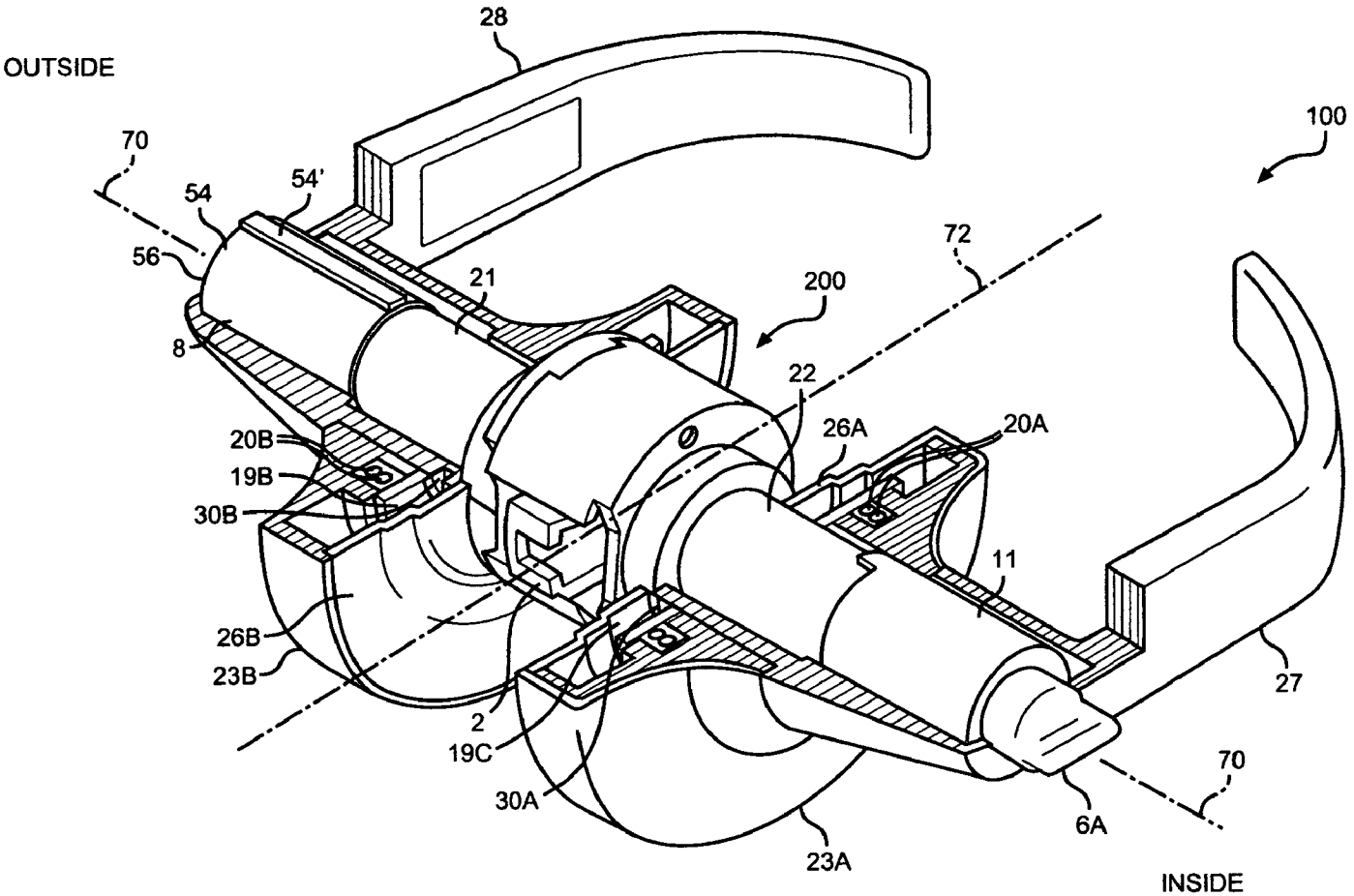
FIG. 5 is a schematic, perspective assembled view of an exemplary embodiment of the present invention sans door.

As illustrated in FIGS. 5, 6A and 7, for example, when an exemplary embodiment of the door locking mechanism 100 of the present invention is assembled, locking tab 9 may be proximate second longitudinal slot 52B' in, for example, exterior rose 23B such that tab 9 may rotate about lock pin 9B and may be inserted within exterior rose second longitudinal slot 52B' in the locked position. Exterior rose 23B (and interior rose 23A) may be fixedly attached to hub core assembly 200 to prevent rotation of exterior and interior roses 23B, 23A when locking tab 9 is inserted within exterior rose slot 52B' in the locked position, exterior locking cartridge cylinder 8 may be prevented from rotating and thus prevents rotation of exterior handle 28.

This novel arrangement may provide great resistance to any torque applied to exterior handle 28 such as a burglar attempting to defeat the locking mechanism by physically shearing off locking tab 9. As the parts of the present invention may be formed of cast, not rolled, metal this may add additional strength to resist any torque applied to exterior handle 28. Not only the arrangement of locking tab 9, locking cylinder 8, exterior handle 28 and exterior rose 23B, but also the thickness of locking tab 9, that may be, for example, preferably from about 5.5 to 6.5 cm and more preferably about 6.0 cm (15/64"), renders almost any manual application of torque to exterior handle 28 impotent. It is noted that second longitudinal slot 52B' may have a width of from about 31/64" to 35/64" and preferably about 33/64" within which locking tab 9 may be inserted.

The inventors has found that the locking mechanism of the exemplary door locking mechanism 100 of the present invention may not be defeated by torque up to about 3000 pound torque. Thus torque of about 1500, 2000 and 2500 and up to about 3000 pound torque applied to exterior handle 28 have been found not to have opened a locked door locking mechanism 100 made in accordance with the teachings of the present invention. It is noted that in many conventional door locking mechanisms, only about 700 pound torque is necessary to defeat their locking mechanisms.

Figure 13:
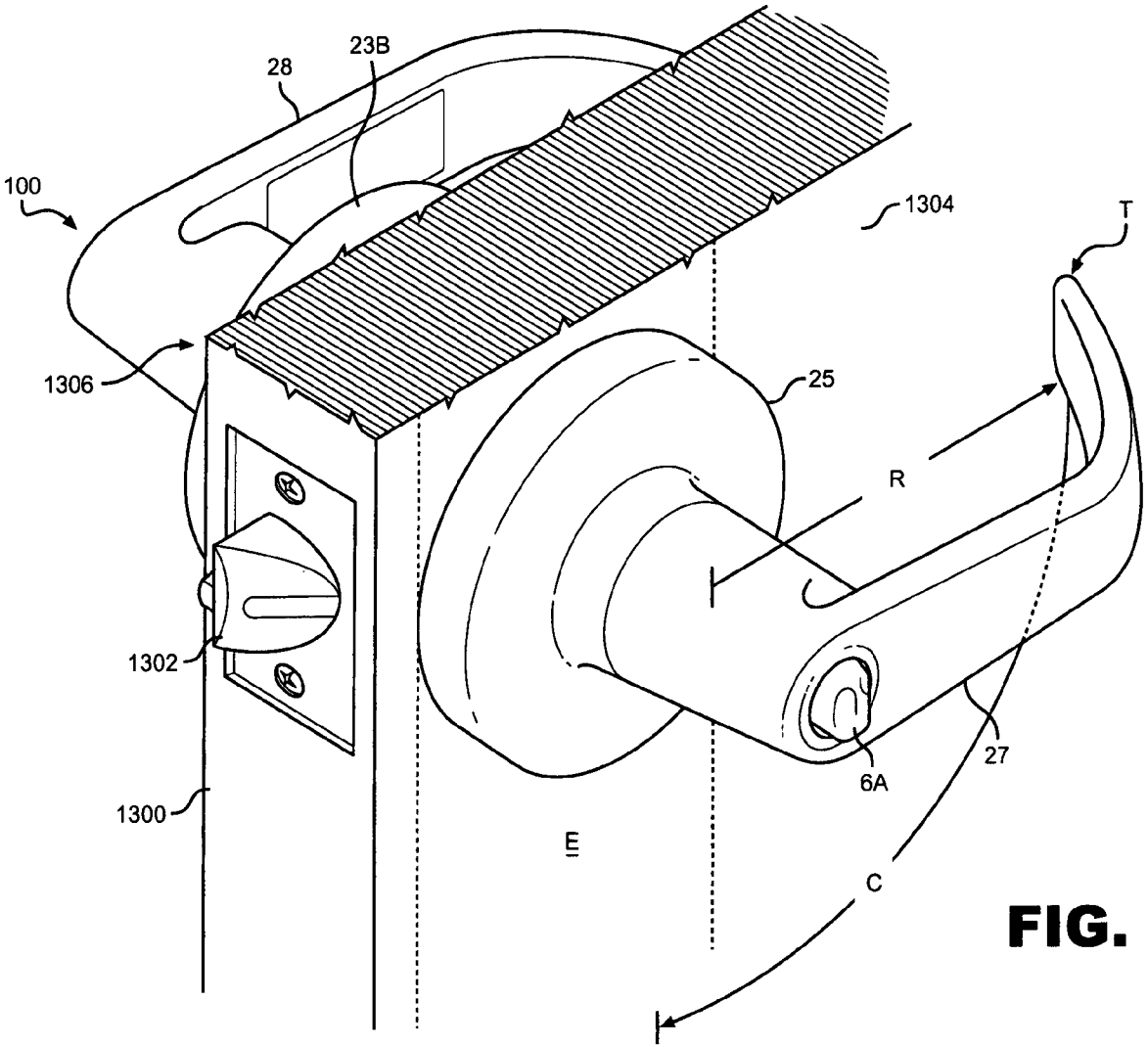

FIG. 13—Door Locking Mechanism Mounted Within Door 1300

It is noted that FIG. 13 illustrates an exemplary embodiment of the present invention having locking mechanism 100 installed in a door 1300 having an interior side 1304 and an exterior side 1306. Latch 1302 is retractable (and from within a door jamb, opening when door 1300 is closed) in the unlocked position.

FIG. 5—Assembled Locking Mechanism 100 Sans Door

FIG. 5, in an exemplary embodiment of the present invention, illustrates the complete assembly of the exemplary door locking mechanism 100 of FIG. 1 sans a door or other structure within which the locking mechanism 100 may be mounted. Although not shown in FIG. 5, a latch (1302—see FIG. 13, for example) may be operably connected to lockcore retractor 2 which (with lockcore retractor 2) may be biased in its extended position such that the latch may seat within an opening in an adjacent door jamb, or the like, to maintain the door (or other structure) in a dosed position. In the unlocked position, rotation of either exterior handle 28 or interior handle 27, may retract lockcore retractor 2 into hub core assembly 200 to withdraw the latch into the door and unseat it from the door jamb opening to permit opening of the door.

FIGS. 6A—Side View of Unlocked Locking Mechanism 100 Sans Door

FIG. 6A, in an exemplary embodiment of the present invention, is a side, cross-sectional view in the unlocked position of the locking mechanism 100 of the present invention shown in FIG. 5 with some details omitted. While FIG. 6A illustrates a so-called Function 53 embodiment, other Functions may be utilized as may be understood by an ordinary person skilled in the art. Function 53 cam and plug 12 may be received within spindle key 15 (which itself may be received within spindle cylinder 21) (also see, for example, FIG. 11).

As illustrated in FIG. 6B, for example, cam and plug 12 may include a depression 12' within which, in the unlocked position, locking tab 9 may rest, biased by lock pin spring 9A. Cam and plug 12 may be biased away from exterior handle 28 by, for example, a spring such as key drive plunger spring 7C as shown in the Figures, to permit locking tab 9 to rest therein maintaining the door locking mechanism 100 in the unlocked position for, for example, Function 53.

FIG. 7—Side View of Locked Locking Mechanism 100 Sans Door

As illustrated in FIG. 7, in an exemplary embodiment of the present invention, to place the locking mechanism 100 of FIG. 6A in the locked position, the cam and plug 12 may be translated to the left from FIG. 6A to FIG. 7 to force locking tab 9 from depression 12' and into second longitudinal slot 52B' in unmoveable exterior rose 23B (see above). This prevents rotation of exterior handle 28 and locks the door.

Cam and plug 12 may be so translated to the left by, for example, the pushing inwardly (towards the exterior handle 28) and turning of lock button 6A of interior locking cartridge 11 which may force plunger 6 to the left and in turn may force cam and plug 12 to the left (towards the exterior of the door/door locking mechanism 100) in FIGS. 6A and 7. As shown in FIG. 11, it is noted that when lock button 6A is so engaged, first and second plunger notches 6B and 6C may engage the respective open ends of U-shaped catch slide 4 of the lockcore retractor assembly 250.

For a Function 80 embodiment (see FIG. 9, for example) that substitutes cam 14 for Function 53 cam and plug 12 that is shown in FIGS. 6A and 7, for example, locking mechanism 100 is normally in the locked position as cam 14 does not have an analogous Function 52 depression 12' so locking tab 9 normally is maintained at least partially within second longitudinal slot 52B' in unmoveable exterior rose 23B. A Function 80 locking mechanism 100 door is opened by inserting and turning a key, for example key 33, which turns spindle key 15 as described in more detail below.

Figure 8:
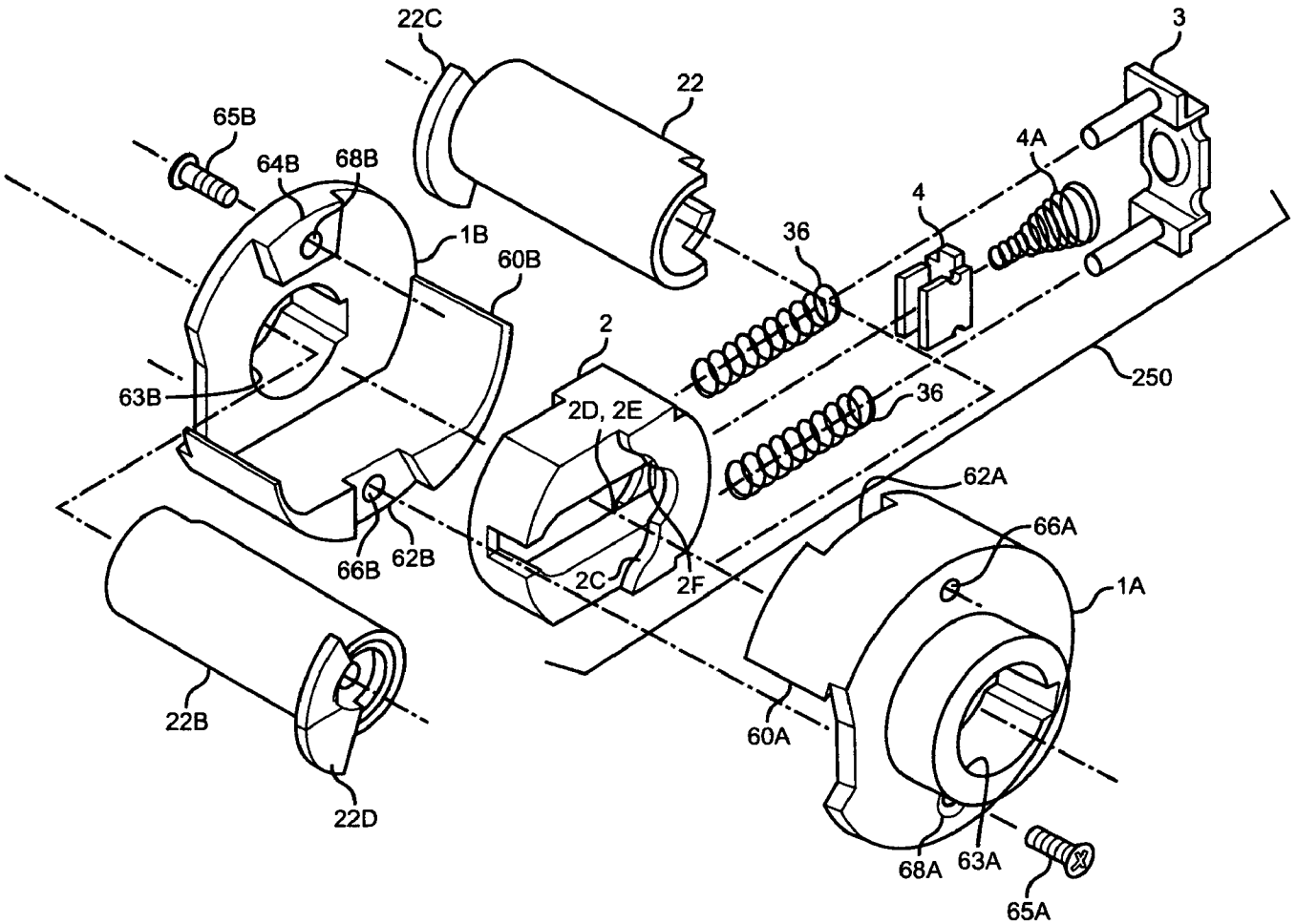
FIG. 8 is a schematic, perspective exploded view of an exemplary hub core with select exemplary associated parts for an exemplary 70 Function embodiment.

FIG. 8—Exploded View of Hub Core Assembly 1 (Function 70) and Lockcore Retractor Assembly 250

As shown in FIG. 8, lockcore retractor assembly 250 may comprise: lockcore retractor 2, latch springs 36, catch slide 4, catch slide spring 4A and spring slide holder 3. This engagement of notches 6B, 6C (see FIG. 6A, for example) with catchslide 4 maintains lock button 6A in the locked position until lock button 6A is turned in the other direction so that cam spring 18 pushes lock button 6A back out and away from hub core assembly 200.

Figure 9:
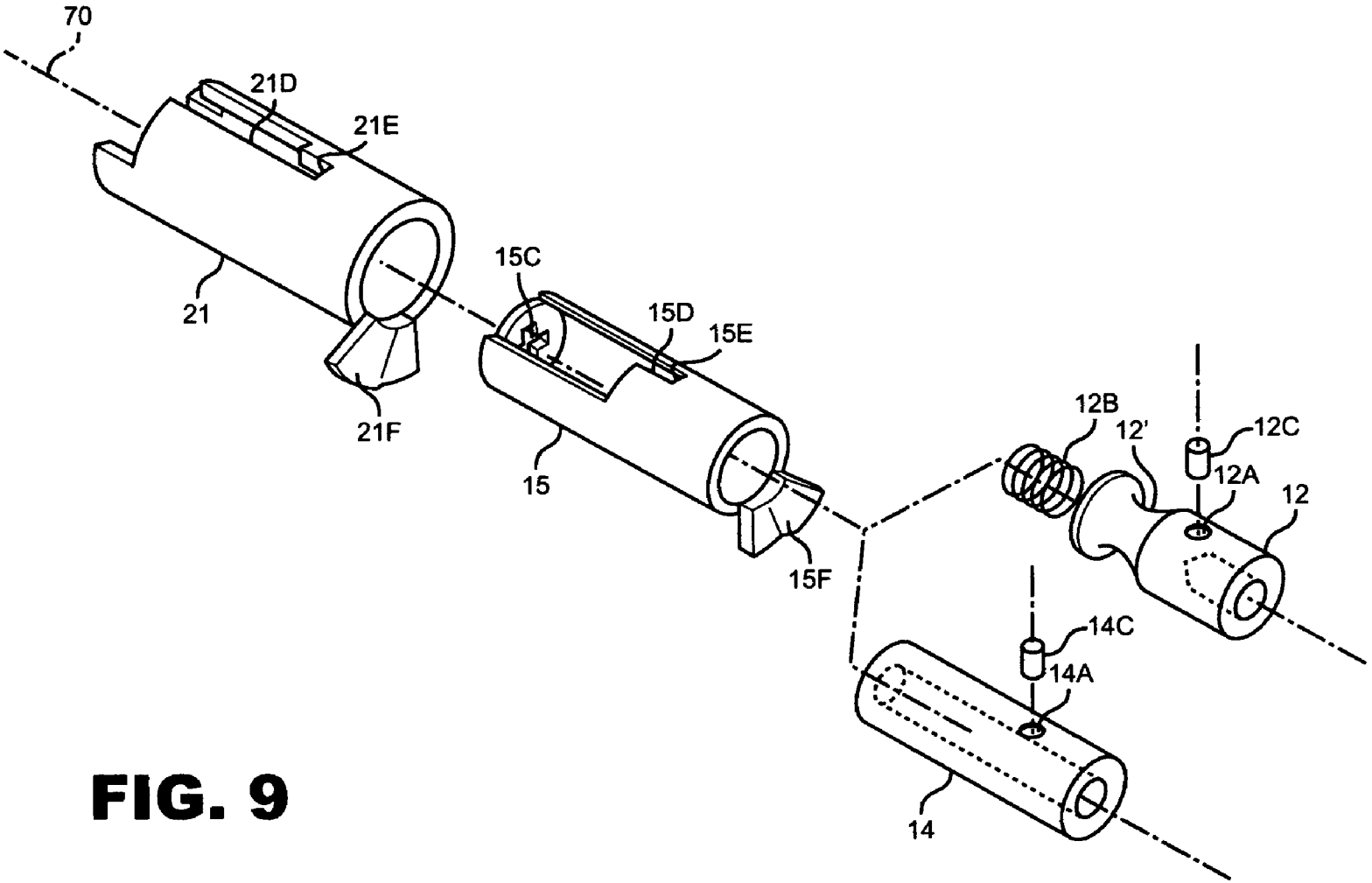
FIG. 9 is a schematic, perspective exploded view of selected parts of alternate exemplary 53 Function and 80 Function embodiments.

As shown in FIG. 9, in another alternative exemplary embodiment in achieving the locked position is to lock the exterior door by inserting a key 33 (see FIGS. 6 and 7, for example) into the exposed exterior end of key drive assembly 7A and turning key 33. A portion of key drive plunger 7 of key drive assembly 7A may be inserted into, for example, the cross-shaped opening 15C of spindle key 15 (see FIG. 9, for example). Spindle key 15 may rotate upon the turning of key 33 and spindle key cam 15F may then engage lockcore retractor 2 to retract lockcore retractor 2 into hub core assembly 200 which may retract latch (1302) into the door (1300) and out of door jamb opening adjacent latch 1302 when door 1300 is dosed (see, for example, FIG. 13). For example, use of a key, such as, for example, key 33 is the only way to open any door or other structure utilizing a Function 80 locking mechanism 100 in accordance with the teachings of the present invention.

It is noted the novel and unique structure of the exemplary embodiments of the present invention may not only have the essential elements of locking mechanism 100 made of strengthened elements, i.e., for example, exterior handle 28, exterior rose 23B and locking tab 9, but these elements may also be arranged in such a manner that greatly increases the amount of torque necessary to apply to exterior handle 28 to defeat the door locking mechanism 100 of the present invention as noted above.

FIG. 8—Hub Core Assembly 1

FIG. 8, in another exemplary embodiment of the present invention, illustrates novel features of the outside/exterior housing 1B and the inside/interior housing 1A that may partially comprise hub core assembly 1. It is noted that FIG. 8 also illustrates interior cylinder 22 together with exterior cylinder 22B used for a Function 70 embodiment (also see, for example, FIG. 10). In a Function 70 embodiment, exterior cylinder 22B replaces spindle key 15 and spindle cylinder 21 shown in, for example, FIGS. 10 and 8. Also shown in retractor assembly 250 which may be seated within hub core assembly 1.

Hub core assembly 200 may include a first housing 1A and an opposing second housing 1B. The second housing 1B includes a protruding first portion 60A having a notch 62A and a protruding second portion (analogous to protruding second portion 64B of first housing 1A—see below). The first housing 1B includes a protruding first portion 60B having a notch 62B and a protruding second portion 64B. The second housing 1B and first housing 1A are substantially mirror images of each other so that the second housing protruding second portion seats within the first housing notch 62B and the first housing protruding second portion MB seats within the second housing notch 62A.

Second housing 1B may include a first threaded opening 66A and a second threaded opening 68A. First housing 1A may include a first threaded opening 66B and a second threaded opening 68B. A first threaded screw 65A may be inserted and threaded within second housing second threaded opening 68A and into first housing first threaded opening 66B, and a second threaded screw 65B may be inserted and threaded within first housing second threaded opening 68B and into second housing first threaded opening 66A to fixedly retain second housing 1B to first housing 1A. These unique structural features of second and first housings 1B, 1A permit them to mate to avoid any relative rotational movement to each other and to render such relative rotational movement essentially impossible when properly affixed to each other by, for example, using first and second threaded screws 65A, 65B.

Interior cylinder 22 may include cam 22C which may ride on cam follower 2C of lockcore retractor 2. Exterior cylinder 22B may include cam 22D which may ride on either cam follower 2D, 2E of lockcore retractor 2 upon the respective rotation of interior cylinder 22 and exterior cylinder 22B.

As shown in FIG. 8, for a Function 70 embodiment, inside/interior cylinder 22 may be inserted within interior housing central opening 63A (also for Function 53 and 80 embodiments) so that its end 300A opposite cam 22C protrudes from second housing 1B (also the inside end of hub core assembly 1—see FIG. 1, for example). Outside/exterior cylinder 22B may be inserted within exterior housing central opening 63B so that its end 300B opposite cam 22B (also the outside end of hub core assembly 1—see FIG. 1, for example) protrudes from first housing 1A.

FIG. 9—Exemplary Function 53 and Function 80 Embodiments

FIG. 9, in an exemplary embodiment of the present invention, illustrates alternate exemplary Function 53 and Function 80 embodiments. Each Function 53 and Function 80 embodiment utilizes cylindrical spindle 21 and cylindrical spindle key 15 which may be received within spindle 21.

Spindle key 15 may include slot 15D having a stop 15E. Spindle key 15 may further include cam 15F and opening 15C, which may be cross-shaped as shown. Key drive plunger 7 of key drive assembly 7A may be received within cross-shaped opening 15C. Thus, turning of key 33 turns key drive plunger 7 and so spindle key 15 retracts retractor 2 further within hub core assembly 1 to retract a latch (not shown) attached to retractor 2 from a latch opening (not shown) in an adjacent door jamb (not shown) or the like so the door or other structure (not shown) may be opened.

Spindle 21 may include slot 21D having a stop 21E. Spindle 21 may further include cam 21F.

Function 53 may include cam and plug 12. Cam and plug 12 may include cam and plug opening 12A within which a cam and plug pin 12C may be received. Pin 12C may be inserted within spindle slot 15D/spindle cylinder slot 21D and move translationally therein with respective spindle stop 15E/spindle cylinder stop 21E limiting movement of pin 12C.

Function 80 may include, instead of cam and plug 12, cam 14. Cam 14 may include cam opening 14A within which a cam pin 14C may be received. Pin 14C may be inserted within spindle slot 15D/spindle cylinder slot 21D and move translationally therein with respective spindle stop 15E/spindle cylinder stop 21E limiting movement of pin 14C.

FIG. 10—Exemplary 70 Function Embodiment

Figures 10A, 10B:
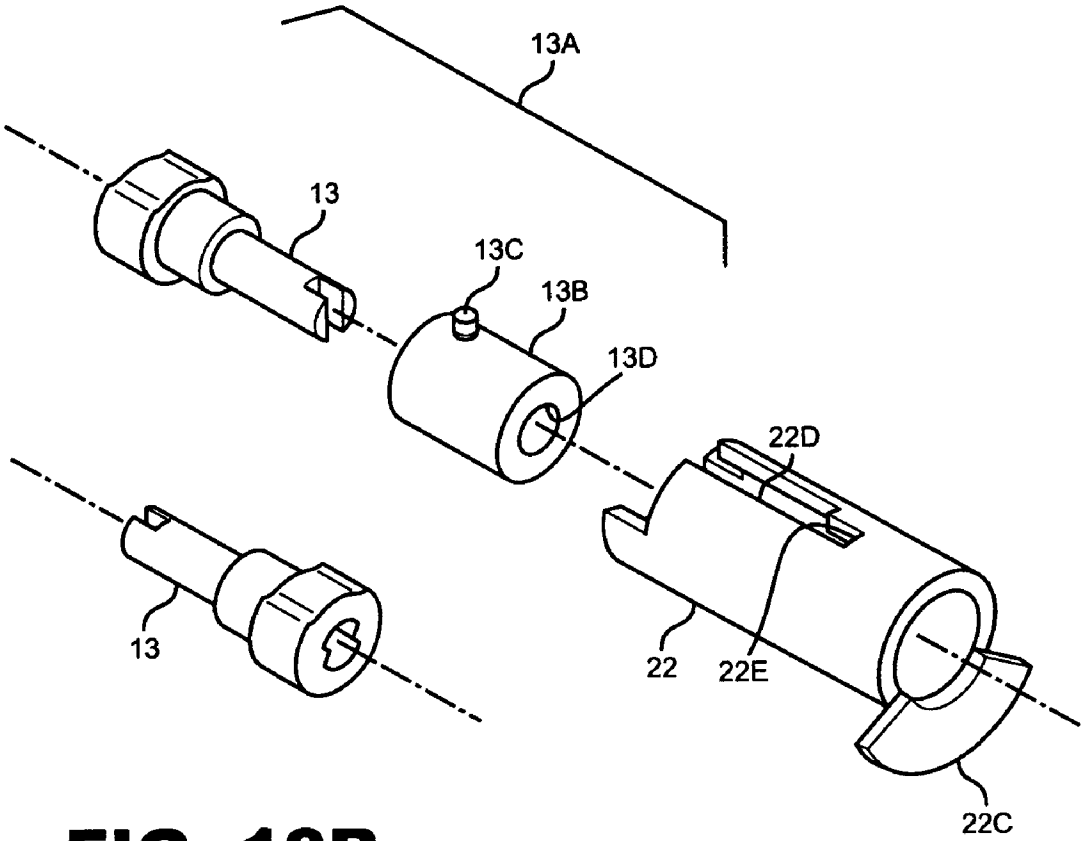
FIGS. 10A and 10B are a schematic, perspective exploded views of selected parts of an exemplary 70 Function embodiment.

FIGS. 10A and 10B, in an exemplary embodiment of the present invention, illustrate a Function 70 embodiment.

Function 70 may include cam and rod 13A that may comprise off-center rod portion 13 and off-center rod cylinder 13B. Off-center rod cylinder 13B may include protruding pin 13C and longitudinal opening 13D within which the off-center rod of the off-center rod portion 13 may be inserted. Pin 13C may be received within slot 22D of spindle 22 and limited by stop 77F FIG. 11—Exploded View of Locking Mechanism 100

As discussed above, FIG. 11, in an exemplary embodiment of the present invention, illustrates an exploded view of locking mechanism 100 of the present invention (but see the above discussion of the Function 53, 70 and 80 embodiments) that may be used as an overall reference as needed. FIG. 11 also illustrates, for example, interior locking cartridge 11 with lock button 6A removed from one end of plunger 6 and lock button collar 17 and biased outwardly by spring 11A.

FIGS. 12A Through 12H—Further Exemplary Embodiment of Locking Tab Mechanism 102

FIGS. 12A through 12H illustrate a further exemplary embodiment of the present invention, that is an alternate locking tab mechanism 102 for which the previously described invention may accommodate in place of the previously described locking tab mechanisms. For example, alternate locking tab mechanism 102 may be substituted for cam and plug 12 and with removal of locking tab 9 (shown in, for example, FIG. 11).

Figure 12C:
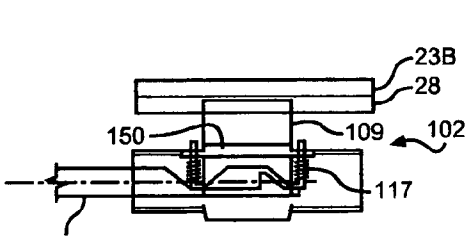
FIGS. 12A through 12H are schematic views of an alternate exemplary embodiment of a locking tab mechanism.
Figure 12B:
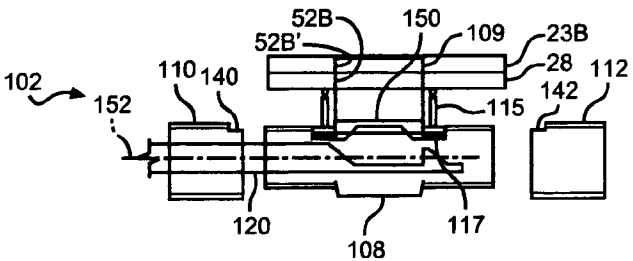
Figure 12D:
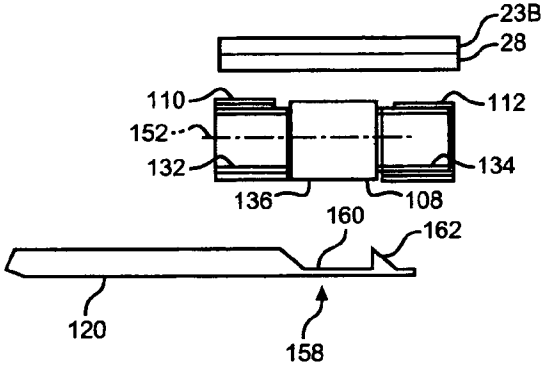
Figure 12F:
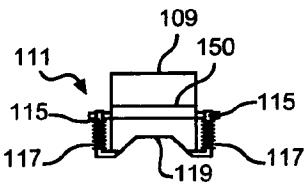
Figure 12E:
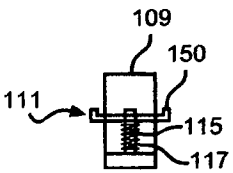
Figure 12A:
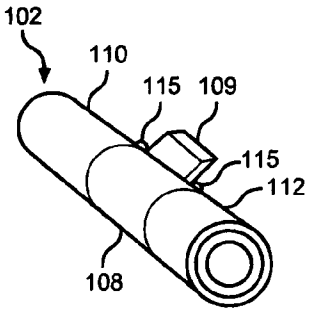

As illustrated in FIGS. 12A and 12B, for example, alternate locking tab mechanism 102 includes a central tubular section 108 within which spring-loaded locking tab 109 is retained by, for example, opposing retaining sleeves 110, 112.

Figure 12H:
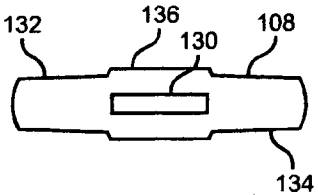

As illustrated in FIG. 12H, for example, central section 108 may include a cut out 130 within which spring-loaded locking tab 109 may fit. Central section 108 may include opposing reduced sections 132, 134 (see FIG. 12D, for example) on either side of middle section 136 over which respective retaining sleeves 110, 112 may be placed and then maintained by suitable means after placement of locking tab 109.

As best shown in FIGS. 12E (a side view of FIG. 12F) and 12F, for example, locking tab structure 111 includes locking tab 109, lower opposing posts 115 each receiving a spring 117 adapted for compression and a lower depression 119 that may be generally midway between opposing posts 115 as shown in FIG. 12F, for example. A central balancing bar 150 may also be employed of which opposing ends are adapted to move with each spring 117. Balancing bar 150 may assist in ensuring a smooth and essentially perpendicular movement of locking tab 109 through cutout 130 (see FIG. 12H, for example) and in relation to a longitudinal axis 152 (see FIG. 12D for example) of central tubular section 108 of locking tab mechanism 102. Balancing bar 150 may also minimize jamming of springs 117.

Figure 12G:
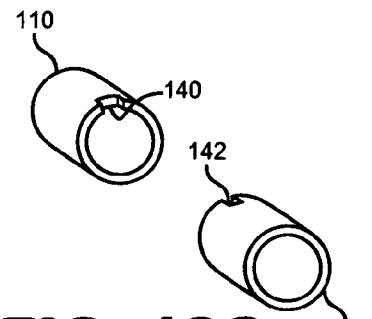

As further illustrated in FIGS. 12B, 12D and 12G, for example, each retaining sleeve 110, 112 includes a respective shoulder cutout 140, 142. When retaining sleeves 110, 112 are inserted over respective reduced sections 132, 134 of central tubular section 108 after the insertion of locking tab 109 through cutout 130, the upper ends of each opposing post 115 of locking tab 109 protrude from shoulders 140, 142 while retaining springs 117 within central tubular section 108 which interengage respective shoulders 140, 142. Shoulders 140, 142 are adapted to permit unimpeded translational movement of posts 115 therethrough, essentially perpendicular to longitudinal axis 152. Springs 117 bias locking tab 109 in the unlocked position as shown in FIG. 12C, for example.

Locking tab 109 is adapted for translational movement from a locked position as shown in, for example, FIG. 12B (with retaining sleeves 110, 112 shown next to central section 108) and an unlocked position as shown in, for example, FIGS. 12A and 12C (sans opposing sleeves 110, 112). In the locked position (as shown in FIG. 12B, for example), locking tab 109 is at least partially inserted into opening 52B' of rose 23B (as well as into opening 52B of lever 28) to prevent rotational movement of lever 28 in relation to rose 23B. In the unlocked position (FIG. 12C, for example), no part of locking tab 109 is within at least rose opening 52B' to permit unrestricted rotational movement of lever 28 in relation to rose 23B.

Plunger 120 is adapted for translational movement roughly parallel to longitudinal axis 152 as driven by a key or other locking/unlocking means. FIG. 12 D illustrates a cross sectional view of a portion of rose 23B and lever 28; proximate tubular section 108 with opposing sleeves 110, 112 affixed thereto and plunger 120 apart from tubular section 108. As best illustrated in FIG. 12D, plunger is elongated with a forward end 158 having cut out 160 and terminating in projection 162 that are each adapted to move spring-loaded locking tab 109 through cutout 130 in a roughly perpendicular motion relative to longitudinal axis 152.

That is, for example, in an unlocked position illustrated in FIG. 12C, for example, plunger 120 is withdrawn from section 108 to permit plunger projection 162 to fit within locking tab lower depression 119 and allowing locking tab 109 to 'turtle' back within section 108 and without at least rose opening 52B'. As noted above, springs 117 bias locking tab 109 in this unlocked position.

In the locked position as shown in FIG. 12B, for example, plunger 120 is moved further within central section 108 roughly parallel to axis 152 so that plunger projection 162 rides on one sloped side of lower depression 119 of locking tab 109 to urge locking tab 109 out of central section 108 through cutout 130 so that at least an upper, distal portion of locking tab is inserted within rose opening 52B' to the locked positon.

Use of Outside Handle, 28, Key 33 and Inside Handle 27 To Open Door (1300)

In a Function 53 or 80 assembly, for example, it is noted that rotation of outside handle 28 may rotate spindle cylinder 21 whose cam 21F may ride on retractor cam follower 2D to retract retractor 2 and hence the latch 1302 from within the door jamb, opening to permit opening of the door 1300 or other structure within which the locking mechanism 100 resides. For example, see FIG. 13. Insertion and rotation of key 33 may rotate key drive plunger 7 of key drive assembly 7A which may rotate spindle key 15 whose cam 15F may ride on retractor cam follower 2E to retract retractor 2, etc. as before to permit opening of the door 1300. Rotation of inside handle 27 may rotate interior cylinder 22 whose cam 22C may ride on retractor cam follower 2C to retract retractor 2, etc. as before to permit opening of the door 1300.

In a Function 70 assembly, for example, exterior cylinder 22B replaces spindle key 15 and spindle cylinder 21 so that exterior cylinder cam 22D may ride on retractor cam follower 2D, 2E to retract retractor 2, etc. as before to permit opening of the door 1300. Other Function assemblies may be used with the locking mechanism 100 in a manner to permit opening of the door 1300 in an analogous manner as just described. Thus, key 33 and inside handle 27 may open the door 1300 regardless of the position of locking tab 9 be it within or without second longitudinal slot 52B' in exterior rose 23B, for example. It is noted that if a second, interior locking cartridge is utilized with interior handle 27/interior rose 23A, then the position of the interior locking cartridge locking tab within or without the interior rose longitudinal slot may affect the ability of interior handle 27 to rotate and open the door 1300.

Use of the Present Invention with Larger Escutcheons

It is noted that the present invention permits attachment of handles 27, 28 without rotating them on threaded shafts or the like to circumscribe a radius about the outer tips T of handles 27, 28. In prior designs, such handles would be mounted on a threaded shaft or the like requiring rotation of the handles at assembly. As is evident by the exemplary design of handles 27, 28 shown in FIG. 11, for example, any such rotation of the handles would cause the outer tips of handles 27, 28 to contact any escutcheon E, that is an ornamental or protective plate around a keyhole or door handle, that would exceed a radius R scribed by the tips T of handles 27, 28 (e.g., see FIG. 13).

In the instant invention, the fixing of handles 27, 28 do not require rotation of handles 27, 28 so that escutcheons E sized to exceed any radius R defined by rotation of the handle tips T may be used in conjunction with the instant design. For example such large square or rectangular escutcheons (e.g., see the dashed lines defining the width and partial length of escutcheon E) that may be quite ornamental may easily be used with the instant design. For example, FIG. 13 may illustrate a door opening mechanism, comprising: (1) an opening mechanism adapted to open a door or other structure; (2) at least one handle (27, 28) operatively connected to the opening mechanism by means other than rotation of the least one handle about the door or other structure; and (3) an escutcheon (23B, 25) positioned between the at least one handle and the door or other structure, the escutcheon (e.g., see the dashed lines defining the width and partial length of escutcheon E) sized to exceed a radius R defined by the length of the at least one handle (28, 27) (with the length equal to the radius R).

While particular embodiments of the present invention have been illustrated and described, it is not intended to limit the invention, except as defined by the following claims.

I claim:

1. In a locking mechanism having an unlocked position and a locked position, the locking mechanism comprising:

a) a first handle;

b) a first rose attached to the first handle with the first handle adapted for rotational movement relative to the first rose:

c) a first longitudinal slot in the first rose extending through a width of the first rose, and parallel to a longitudinal axis defined by the locking mechanism;

d) a locking cartridge cylinder at least partially contained within at least the first handle or the first rose; and a locking tab operably connected to the locking cartridge cylinder adapted for movement that is at least partially perpendicular to the longitudinal axis: (1) at least partially into at least the first longitudinal slot in the first rose in a locked position; and (2) completely out of the first longitudinal slot in the first rose in an unlocked position, and a second longitudinal slot in the first handle, wherein the first longitudinal slot in the first rose is alignable with the second longitudinal slot in the first handle.

2. The locking mechanism of claim 1, wherein the locking tab is biased to be at least partially retained within a cavity defined the locking cartridge cylinder in the unlocked position.

3. The locking mechanism of claim 1, further comprising a first longitudinal slot in the first handle and a first longitudinal fin on an exterior surface of the locking cartridge cylinder adapted to seat within at least a portion of the first longitudinal slot in the first handle; a second longitudinal fin on an exterior surface of the locking cartridge cylinder adapted to seat within at least a portion of a longitudinal groove in the first handle, the first handle groove being offset from the first longitudinal slot in the first handle.

4. The locking mechanism of claim 1, further comprising:

a) a hub core assembly operably connected to the first handle at a first side of the hub core assembly; and b) a latch assembly at least partially contained within, and operably connected to, the hub core assembly, the latch assembly including a latch adapted for translational movement roughly perpendicular to a first longitudinal axis drawn from a center point of an axis of rotation of the first handle to and through a center point of the hub core assembly, the latch moveable into and out of an opening in an adjacent jamb upon rotational movement of the first handle in the unlocked position, the latch unmoveable from out of the adjacent jamb opening in the locked position.

5. The locking mechanism of claim 4, further comprising a second handle operably connected to a second, opposing, side of the hub core assembly.

6. The locking mechanism of claim 5, wherein the hub core assembly is mountable within a door, the first handle is exposed on an exterior side of the door and the second handle is exposed on an opposing interior side of the door.

7. The locking mechanism of claim 4, wherein the hub core assembly includes a second housing connected to an opposing first housing, a) the second housing includes:

a protruding first portion having a notch; and a protruding second portion; and b) the first housing includes:

a protruding first portion having a notch; and a protruding second portion;

wherein the second housing protruding second portion seats within the first housing notch and the first housing protruding second portion seats within the second housing notch.

8. The locking mechanism of claim 4, wherein the hub core assembly includes a second housing connected to an opposing first housing, a) the second housing includes:

a substantially protruding first arcuate portion having a notch; and a protruding second arcuate portion; and b) the first housing includes:

a substantially protruding first arcuate portion having a notch; and a protruding second arcuate portion;

wherein the second housing protruding second arcuate portion seats within the first housing notch and the first housing protruding second arcuate portion seats within the second housing notch.

9. The locking mechanism of claim 1, further comprising a second longitudinal slot in the first handle; a first positive stop outside of a spindle and operably connected to the first handle to limit the rotation of the first handle; the first positive stop having a ring shape with:

a central opening;

opposing interior tabs projecting partially into the central opening; and opposing exterior tabs projecting outwardly, away from the central opening.

10. The locking mechanism of claim 1, wherein the locking mechanism is adapted to resist a torque force applied to at least the first handle of at least about 1000 pound torque when in the locked position whereby the first handle does not rotate substantially relative to the first rose.

11. The locking mechanism of claim 1, wherein in the locked position, any torque force applied to the first handle is not substantially applied to the locking tab.

12. A hub core assembly for use in a locking mechanism between a first handle assembly and a second handle assembly, the hub core assembly comprising:

a first housing connected to an opposing second housing;

a) the first housing including:

a protruding first portion having a notch with a first through hole; and a protruding second portion;

b) the second housing including:

a protruding first portion having a notch with a second through hole; and a protruding second portion; and the first housing protruding second portion seats within the second housing notch and the second housing protruding second portion seats within the first housing notch.

13. The hub core assembly of claim 12, wherein the first housing has a first central opening and the second housing has a second central opening; and further including a first handle operably connected to the first housing and adapted for rotational movement.

14. In a locking mechanism having an unlocked position and a locked position, first and second handles each adapted for rotational movement; a hub core assembly operably connected to the first and second handles, a first rose adjacent the first handle and connected to one end of the hub core assembly, the hub core assembly operably connected to a latch assembly having a latch seatable, and removable, from an adjacent jamb opening in the unlocked position and not removable from the adjacent jamb opening in the locked position; the improvement comprising locking means for (a) preventing removal of the latch from an adjacent jamb opening in the locked position, and (b) permitting removal of the latch from an adjacent jamb opening in the unlocked position, the locking means including (i) a locking cartridge at least partially contained within at least the first handle or the first rose, and (ii) a locking tab (I) seatable within the first rose for maintaining the seated latch within the adjacent jamb opening in the locked position, (II) operably connected to the locking cartridge and adapted for movement from a first position in the unlocked position to a second position in the locked position, and (III) biased in the unlocked position by a lock pin spring proximate a lock pin by which the locking tab is operably connected to the locking cartridge.

15. The locking mechanism of claim 14, wherein:

a) the first handle includes a first longitudinal slot and a longitudinal groove parallel to, and offset from, the first longitudinal slot;

b) the first rose includes a second longitudinal slot aligned with the first longitudinal slot;

c) the locking cartridge includes a longitudinal fin on an exterior surface of the locking cartridge adapted to seat within at least a portion of the longitudinal groove in the first handle; and the locking tab adapted for movement at least partially into at least the second longitudinal slot in the first rose in the locked position; and completely out of the second longitudinal slot in the first rose in the unlocked position.

* * * * *